US006755171B1

(12) United States Patent
Brawner et al.

(10) Patent No.: US 6,755,171 B1
(45) Date of Patent: Jun. 29, 2004

(54) TWIN ROTARY VALVES FOR A FOUR STROKE INTERNAL COMBUSTION ENGINE

(76) Inventors: Travis D. Brawner, 9036 Old Hwy 61, Walls, MS (US) 38680; Jan Michael Brawner, 9036 Old Hwy 61, Walls, MS (US) 38680

( * ) Notice: Subject to any disclaimer, the term of this patent is extended or adjusted under 35 U.S.C. 154(b) by 0 days.

(21) Appl. No.: 09/633,640

(22) Filed: Oct. 30, 2000

(51) Int. Cl.[7] ..... F01L 7/16
(52) U.S. Cl. ..... 123/190.17; 123/190.2
(58) Field of Search ..... 123/80 BA, 190.1, 123/190.12, 190.2, 190.3, 190.17

(56) References Cited

U.S. PATENT DOCUMENTS 1,116,999 A * 11/1914 Crawford ..... 123/80 BA
1,164,605 A * 12/1915 Wilson et al. ..... 123/190.1
1,210,672 A * 1/1917 Morse ..... 123/80 BA
1,213,068 A * 1/1917 Box ..... 123/80 BA
2,155,143 A * 4/1939 McDermett ..... 123/190.6
4,036,184 A * 7/1977 Guenther ..... 123/286
4,077,382 A * 3/1978 Gentile ..... 123/190.2
4,134,381 A * 1/1979 Little ..... 123/190.17
4,545,337 A * 10/1985 Lyons et al. ..... 123/80 BA
4,658,776 A * 4/1987 Coman ..... 123/190.8
5,003,942 A * 4/1991 Hansard ..... 123/190.2
5,052,349 A * 10/1991 Buelna ..... 123/190.17
5,410,996 A * 5/1995 Baird ..... 123/190.2
5,503,124 A * 4/1996 Wallis ..... 123/190.1
5,540,054 A * 7/1996 Bullivant ..... 123/190.8
5,579,730 A * 12/1996 Trotter ..... 123/80 BA
5,941,206 A * 8/1999 Smith et al. ..... 123/190.4

* cited by examiner

*Primary Examiner*—F. Daniel Lopez

(57) ABSTRACT

A rotary valve that includes three sealing blades and four sealing rings. Two on each end. The valve assembly rotates at one half of crank speed, for a (single cylinder four-cycle engine.) This aligns timing of the port in the valve with the port of the cylinder head. This enables intake/exhaust functions. Within the open end of the valve are stationary impeller fins, (rotating at the same speed) provides improved fuel/air mixture and flow characteristics with less polution.

17 Claims, 5 Drawing Sheets

SCALE: 0.75 = 1.00

SCALE: 0.75 = 1.00

INTAKE
20

SCALE: 0.75 = 1.00

EXHAUST
22

TWIN ROTARY VALVES FOR A FOUR STROKE INTERNAL COMBUSTION ENGINE

BACKGROUND OF THE INVENTION

This invention relates to a cylinder head for an internal combustion engine, having a rotary intake valve and a rotary exhaust valve.

SUMMARY OF THE INVENTION

The twin rotary impeller fin valves provide an improved intake and exhaust valve system for an internal combustion engine. Each of the rotary valves include three sealing blades and four sealing rings. Impeller fins are fixed to each of the rotary valves, improving efficiency, and, in the case of the intake valve, enhance fuel atomization of the fuel/air mixture.

BRIEF DESCRIPTION OF THE DRAWINGS

FIG. 2 is a cross sectional view of the rotary intake valve and a part of the internal combustion engine with.

FIG. 3 is a cross sectional view of the rotary exhaust valve and a part of the internal combustion engine with.

DETAILED DESCRIPTION OF THE INVENTION

Figure 1:
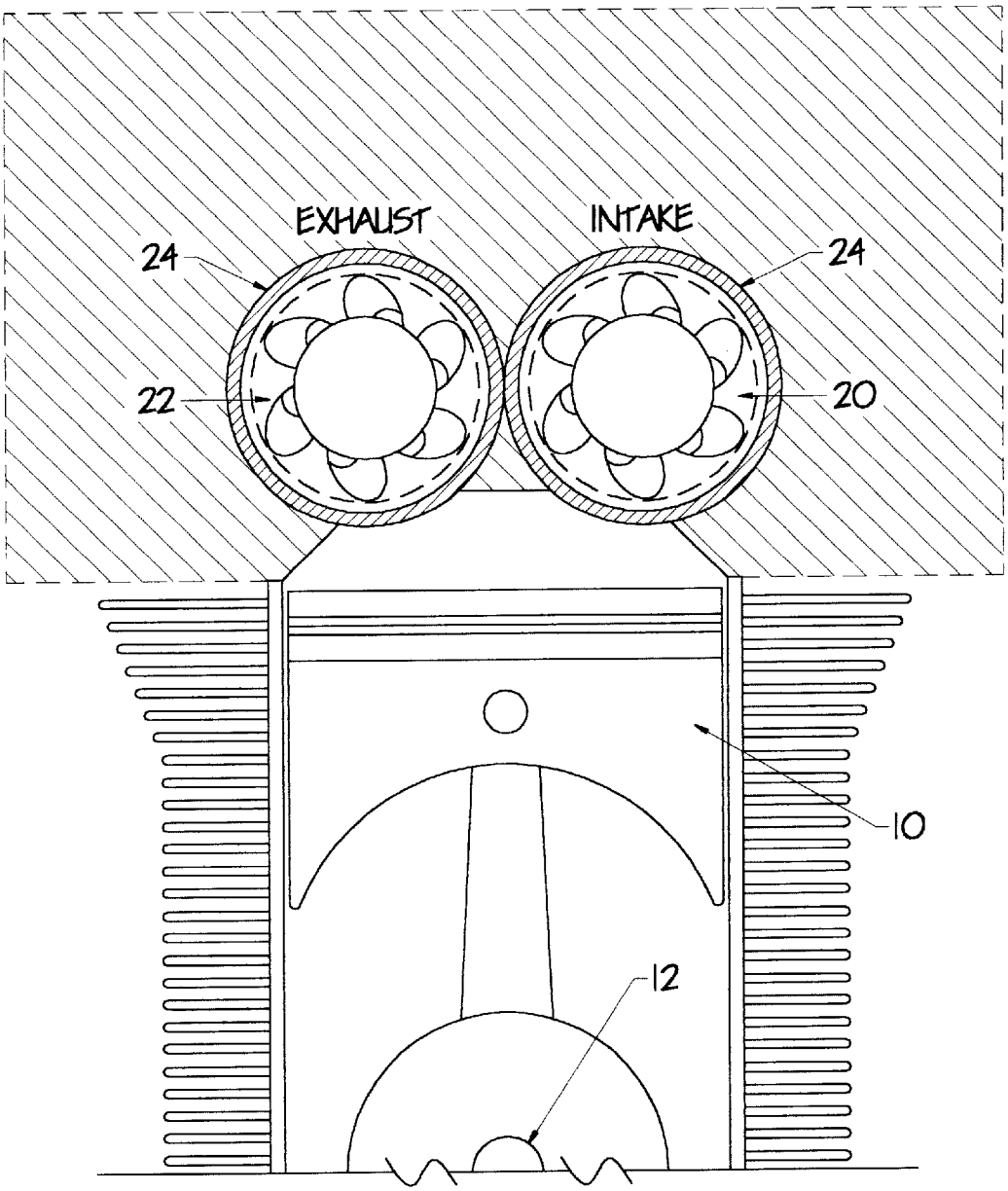
FIG. 1 is a cross sectional view of an internal combustion engine with the rotary intake and exhaust valves.

The overall invention is best shown by FIG. 1, which shows a four stroke internal combustion engine having a piston (10) connected by a connecting rod to a crankshaft (12). In the head of the internal combustion engine is a rotary intake valve (20), inserted in a first bore, and a rotary exhaust valve (22), inserted in a second bore. Between each of the bores and the rotary valve is a brass sleeve (24).

Figure 4:
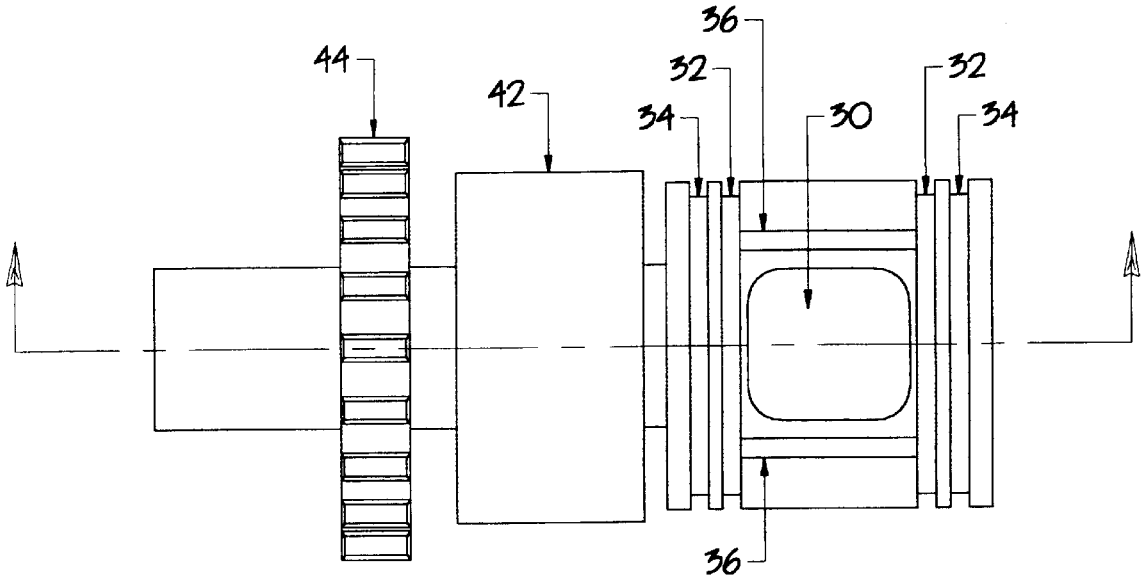
FIG. 4 is a side view of one of the rotary valves.
Figure 4:
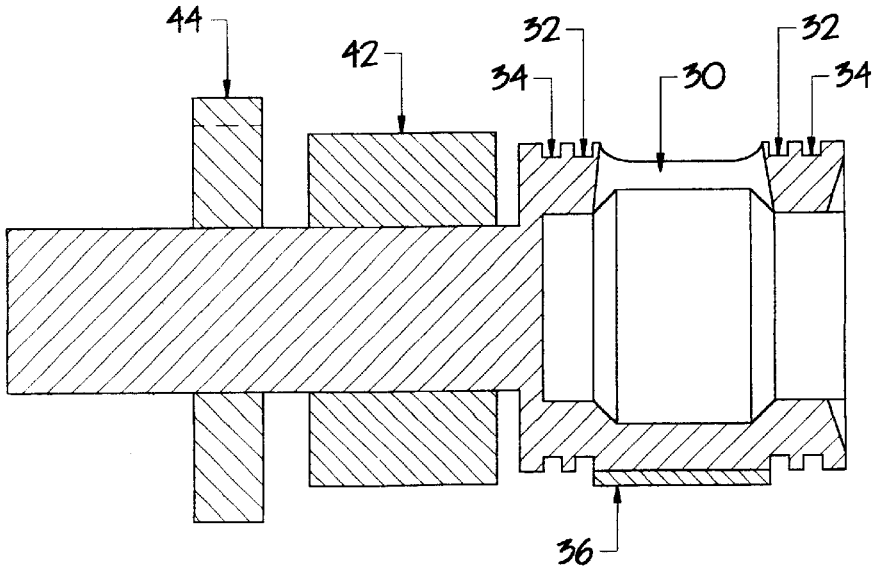
Figure 5:
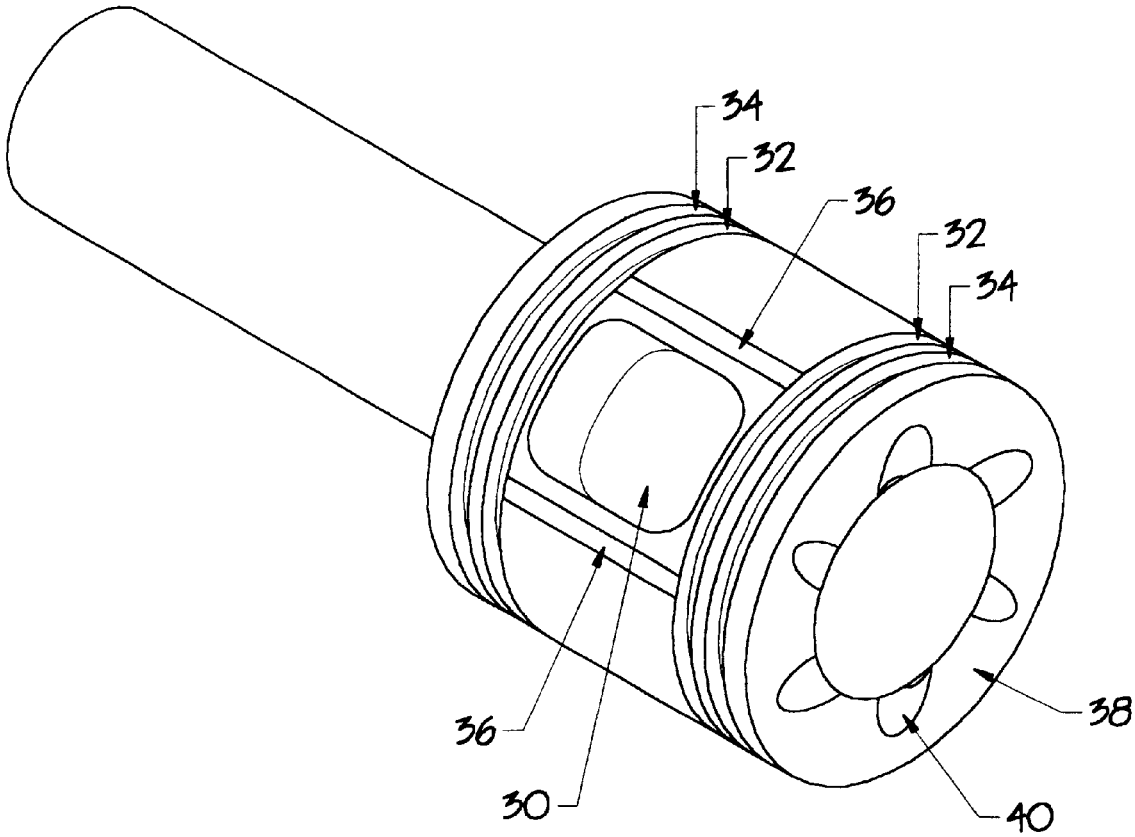
FIG. 5 is an end view of the rotary intake valve, showing the impeller fins.

FIGS. 4 and 5 show details of the rotary valve. The rotary valve includes a cylindrical portion having a rectangular port (30) with four sealing rings (32, 34), two on one side of the port and two on the other side of the port. Between the inner sealing rings (32) is three sealing blades (36), being aligned parallel to the axis of rotation of the valve and axially aligned with the rectangular port. Adjacent the cylindrical portion is a bearing (42) and a timing gear (44). The end (40) of the cylindrical portion, opposite from the bearing and timing gear is open, having impeller fins (38) fixedly mounted therein. The volume and flow characteristics of the impeller fins can be adjusted by adjusting the size pitch and placement of the impeller fins.

Figure 2:
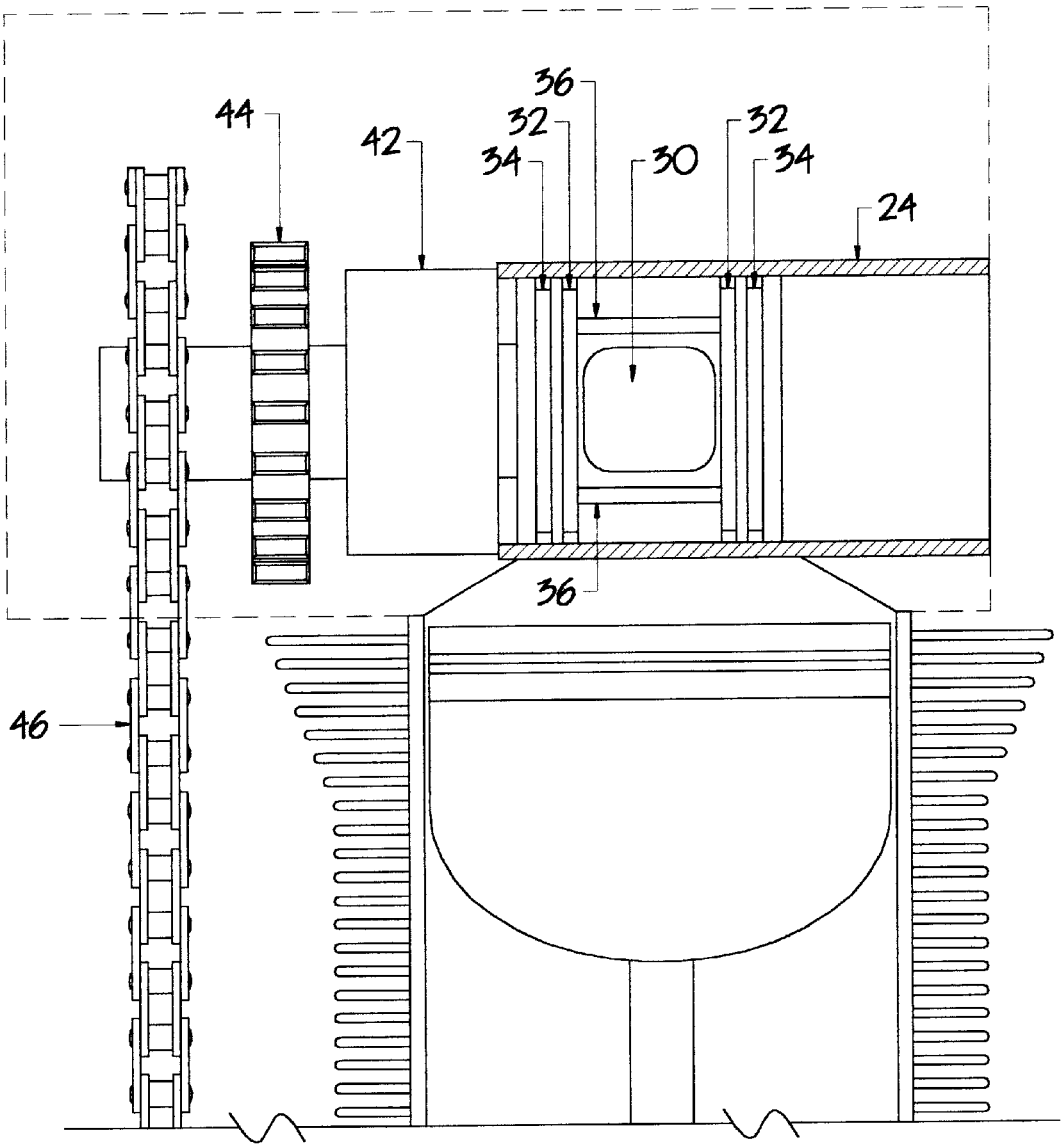
Figure 3:
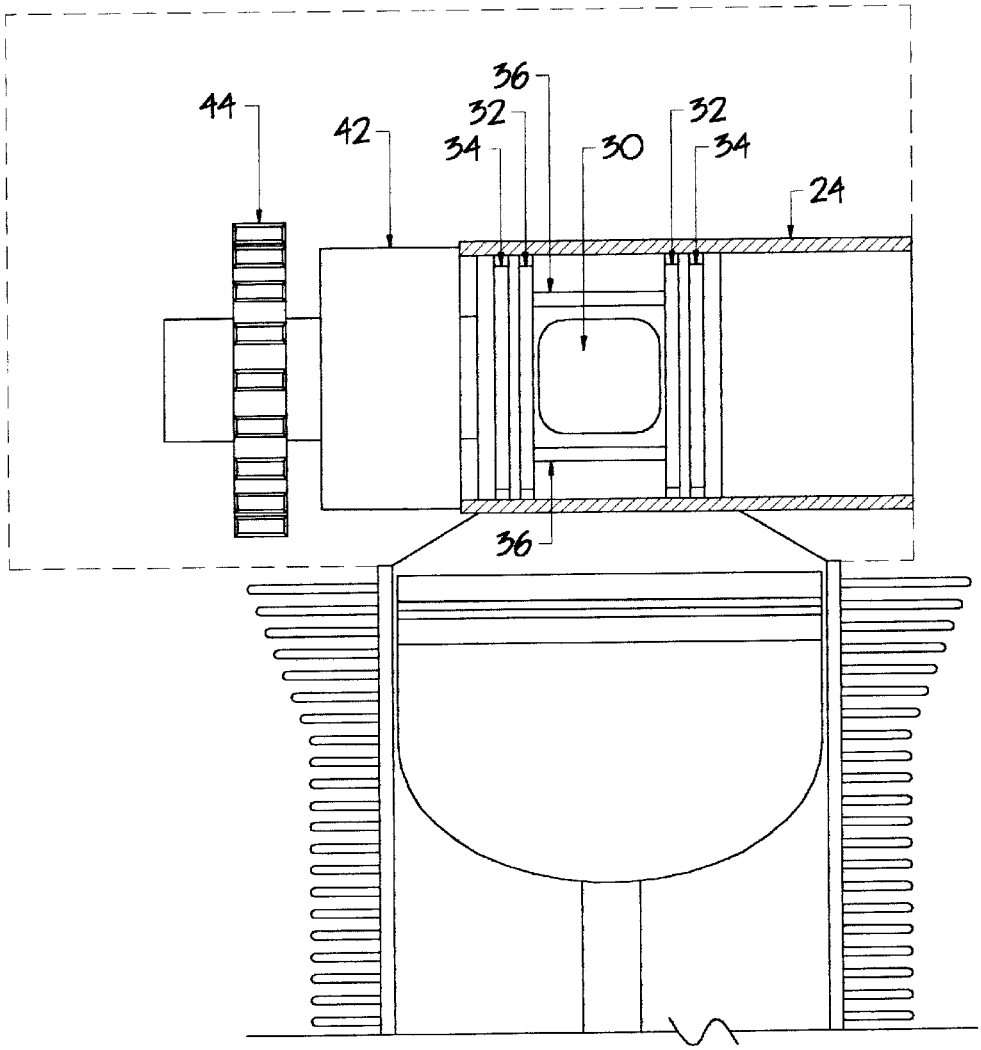

The intake and exhaust valves are shown in FIGS. 2 and 3, being mounted in bores of the cylinder head. They are rotated by the crankshaft, through a belt, chain or gear (46), driving the timing gear (44), at one half the speed of the crankshaft, for a four-cycle engine.

We claim:

1. A valve head for an internal combustion engine comprising an intake port and an exhaust port; a rotary intake valve connected to the intake port and having an axis of rotation; a rotary exhaust valve connected to the exhaust port and having an axis of rotation; wherein at least one of the rotary valves include a tubular member having three and only three sealing blades parallel to the corresponding axis of rotation.

2. An internal combustion engine including all of the limitations of claim 1 and further including impeller fins fixed within an open end of the tubular member.

3. An internal combustion engine including all of the limitations of claim 1 and further including that both of the rotary valves include tubular members, and each of the tubular members includes three and only three sealing blades parallel to the corresponding axis of rotation.

4. An internal combustion engine including all of the limitations of claim 3 and further including impeller fins fixed within an open end of each of the tubular members.

5. An internal combustion engine including all of the limitations of claim 1 and further including that each of the rotary valves are rotatably located within a brass sleeve.

6. An internal combustion engine including all of the limitations of claim 1 and further including that the rotary valves are rotated by a gear or belt mechanism.

7. An internal combustion engine including all of the limitations of claim 1 and further including a rectangular port in the tubular member.

8. An internal combustion engine including all of the limitations of claim 7 and further including a first sealing ring adjacent a first side of the rectangular port and one side of the sealing blades, and a second sealing ring adjacent a second side of the rectangular port and a second side of the sealing blades.

9. An internal combustion engine including all of the limitations of claim 8 and further including that the first sealing ring includes a pair of sealing rings, and the second sealing ring includes a pair of sealing rings.

10. A valve head for an internal combustion engine comprising an intake port and an exhaust port; a rotary intake valve connected to the intake port and having an axis of rotation; a rotary exhaust valve connected to the exhaust port and having an axis of rotation; wherein at least one of the rotary valves include a tubular member having a rectangular port; axially aligned with the rectangular port are three and only three sealing blades; and wherein the sealing blades are aligned parallel to the corresponding axis of rotation.

11. An internal combustion engine including all of the limitations of claim 1 and further including impeller fins fixed within an open end of the tubular member.

12. An internal combustion engine including all of the limitations of claim 1 and further including that both of the rotary valves include tubular members, and each of the tubular members includes three and only three sealing blades parallel to the corresponding axis of rotation.

13. An internal combustion engine including all of the limitations of claim 3 and further including impeller fins fixed within an open end of each of the tubular members.

14. An internal combustion engine including all of the limitations of claim 1 and further including that each of the rotary valves are rotatably located within a brass sleeve.

15. An internal combustion engine including all of the limitations of claim 1 and further including that the rotary valves are rotated by a gear or belt mechanism.

16. An internal combustion engine including all of the limitations of claim 1 and further including a first sealing ring adjacent a first side of the rectangular port and one side of the sealing blades, and a second sealing ring adjacent a second side of the rectangular port and a second side of the sealing blades.

17. An internal combustion engine including all of the limitations of claim 8 and further including that the first sealing ring includes a pair of sealing rings, and the second sealing ring includes a pair of sealing rings.

* * * * *